United States Patent [19]

Bell

[11] Patent Number: 4,998,412

[45] Date of Patent: Mar. 12, 1991

[54] BLOCKAGE ALERT AND PURGE SYSTEM

[76] Inventor: Joel Bell, 607 Maple Dr., Margate, Fla. 33063

[21] Appl. No.: 467,395

[22] Filed: Jan. 22, 1990

[51] Int. Cl.[5] ..... F25B 49/00

[52] U.S. Cl. ..... 62/126; 62/129; 62/285; 62/303; 134/166 C; 138/92

[58] Field of Search ..... 62/77, 85, 125, 126, 62/128, 129, 150, 188, 189, 195, 272, 286, 285, 288, 298, 299, 303; 138/92, 89, 90; 134/166 C, 167 C, 168 C; 285/121; 15/104.05, 104.061, 104.062, 406, 407, 408

[56] References Cited

U.S. PATENT DOCUMENTS

| | | | |
|---|---|---|---|
| 2,564,402 | 8/1951 | MacArthur | 138/92 X |
| 2,602,168 | 7/1952 | Lally et al. | 138/92 X |
| 4,633,673 | 1/1987 | Morrison et al. | 62/285 X |
| 4,787,212 | 11/1988 | Hessey | 62/129 X |
| 4,937,559 | 6/1990 | Meacham et al. | 62/129 X |

*Primary Examiner*—Harry B. Tanner

*Attorney, Agent, or Firm*—M. K. Silverman

[57] ABSTRACT

A sediment alert and purging unit for a condensate drain pan and removal return line of a refrigeration system includes an element for monitoring the level of condensate within the condensate drain pan and removal line of a refrigeration system. The unit further includes a switch element in electrical communication with the monitoring element for disabling at least a compressor and air handler of the refrigeration system responsive to an unacceptable level of condensate within the drain pan and removal line. The inventive unit yet further includes an annunciation element in electrical communication with the switch element to alert a user when a disabling of the compressor and air handler has occurred. The unit also includes a purge port within the condensate removal line and a first condensate line closure valve disposed upstream of the purge port. Further provided is a second condensate line closure valve disposed downstream of the purge port. Through the location of closure valves both upstream and downstream of the purge port, a clogged condensate line may be purged, either upstream or downstream of the purge port by effecting the closure of that closure valve located at that side of the purge valve opposite to where the condensate blockage is believed to exist.

10 Claims, 4 Drawing Sheets

BLOCKAGE ALERT AND PURGE SYSTEM

BACKGROUND OF THE INVENTION

The prior art in the area of air conditioning has long recognized the desirability of mechanically and electrically de-actuating an air conditioning system when a blockage or excessive buil-up of sedimentary material occurs within the condensate line. For example, such patents as U.S. Pat. Nos. 1,188,608 (1960); 2,657,547 (1953); 3,236,061 (1968); and 4,633,673 (1985) recognize the importance of de-activating a refrigeration system when an excessive build-up of condensate or other foreign material develops within the condensate drain pan and line of a refrigeration and air conditioning system.

Such prior art systems often include a warning, alarm or annunciation means of some type to alert the user that the refrigeration system, or more particularly, the compressor thereof, has been de-activated.

Notwithstanding the recognition of the prior art of the desirability of de-activating a refrigeration system when blockage in the drain pan or line thereof occurs, no art known to the inventor teaches a safety and purge system for purging the condensate drain of blockage, at every point where such a blockage can possibly occur, in combination with a warning and de-activation means. As such, the present invention in concerned with the integration, into a single convenient to use and cost-effective system, of features of drain blockage alert, compressor and air handler de-activation, and an upstream and downstream purging capability of employing, as desired, either a positive or negative pressure.

Such a system would be of particular value to home owners and others wishing to protect and service their air conditioning equipment without need for professional assistance.

SUMMARY OF THE INVENTION

The instant invention relates to a sediment alert and purging unit for a condensate drain pan and removal return line of a refrigeration system. The purging unit more particularly comprises means for monitoring the level of condensate within the condensate drain pan and removal line of a refrigeration system. The unit further includes switch means in electrical communication with said monitoring means, for disabling at least a compressor and air handler of said refrigeration system responsive to an unacceptable level of condensate within said drain pan and removal line. The inventive unit yet further includes annunciation means in electrical communication with said switch means, to alert a user when a disabling of the compressor and air handler has occurred.

The unit further includes a purge port within said condensate removal line and a first condensate line closure valve disposed upstream of said purge port. Further provided is a second condensate line closure valve disposed downstream of said purge port. Through the location of closure valves both upstream and downstream of the purge port, a clogged condensate line may be purged, either upstream or downstream of the purge port by effecting the closure of that closure valve located at that side of the purge valve opposite to where the condensate blockage is believed to exist. Either positive or negative fluid pressure can be applied to said purge port to effect the unblocking of the clogged line.

In a second embodiment a single closure valve may be provided within the condensate line with, at respective opposite side of said closure valve, respective first and second purges ports. Through this arrangement, the same effect and benefit in clearing a clogged condensate line may be realized.

It is accordingly an object of the present invention to provide an easy to utilize and cost effective completely integrated condensate drain blockage alert and drain blockage purge unit.

It is another object to provide a unit of the above type which will de-actuate a refrigeration or air conditioning system upon the occurrence of an excessive level of condensate or other foreign material within the condensate drain pain and removal line thereof and which will provide to the owner of such refrigeration or air conditioning equipment a means for readily effecting the purge of the condensate line blockage without need for expensive and/or professional assistance.

The above and yet other objects and advantages of the present invention will become apparent in the hereinafter set forth Detailed Description of the Invention, the Drawings, and Claims appended herewith.

DETAILED DESCRIPTION OF THE INVENTION

Figure 1:
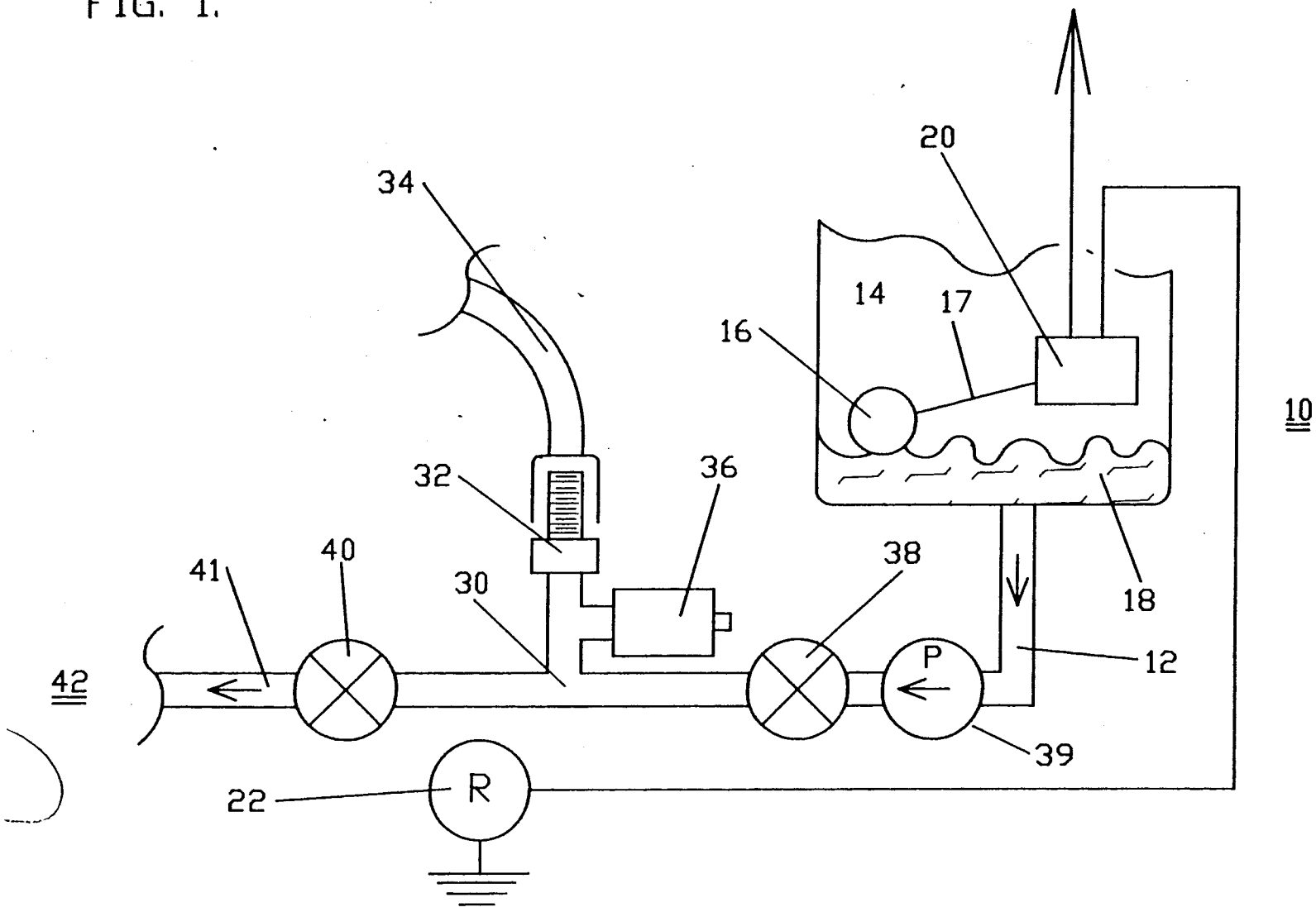
FIG. 1 is a mechanical schematic of a first embodiment of the instant invention.

With reference to the mechanical schematic view of FIG. 1, the inventive sediment alert and purge unit 10 is seen to include a condensate removal line 12 from a drain pan 14 of an air handler or compressor. Within drain pan 14 is shown (in enlarged view) a condensate level 18 and, thereupon, a float 16 which is mechanically attached, vial element 17, to float switch 20. When condensate 18 reaches a predetermined, unacceptable level, switch 20 will open, thereby enabling current to flow to annunciation means 22 which, typically through use of a bulb, will alert a user of the unit that condensate 18 has reached an unacceptable level, such, typically, being caused by a blockage at some point within condensate removal line 12.

Figure 3:
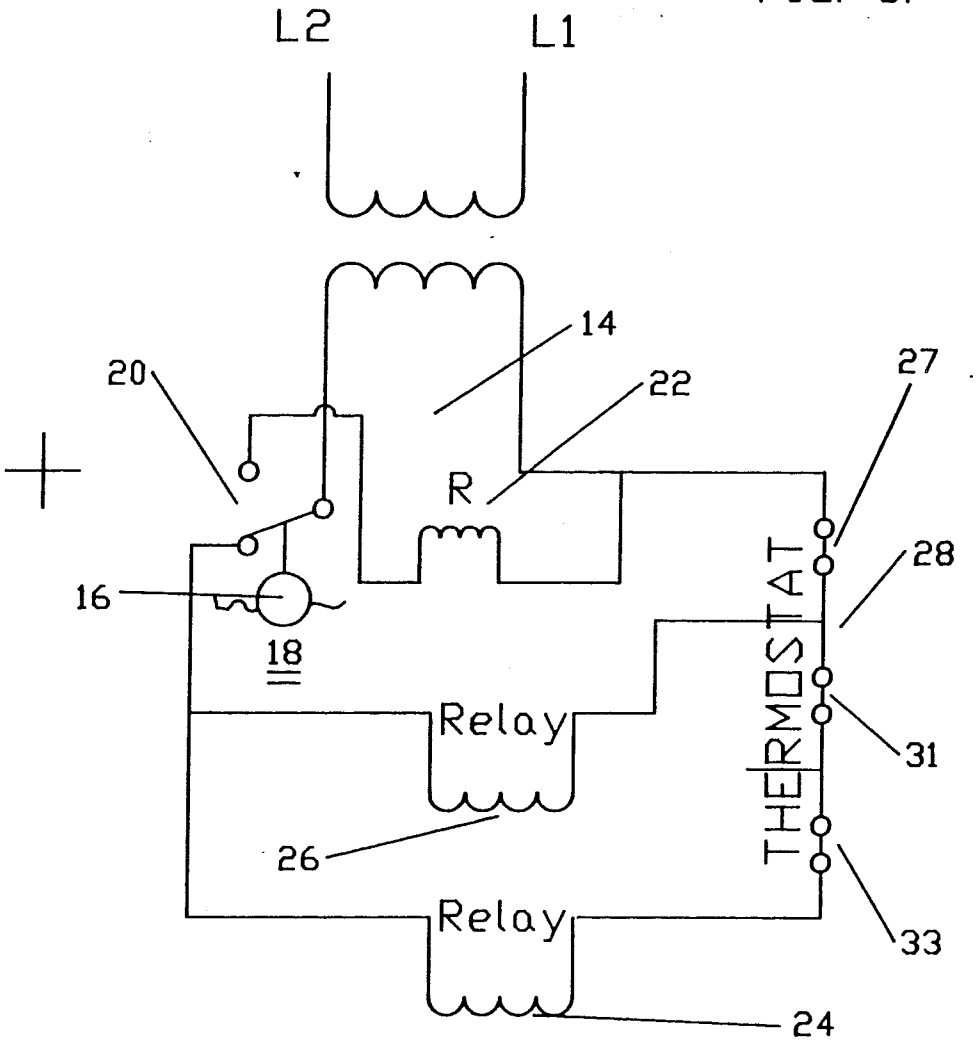
FIG. 3 is an electrical wiring diagram applicable to all embodiments of the inventive unit.
Figure 2:
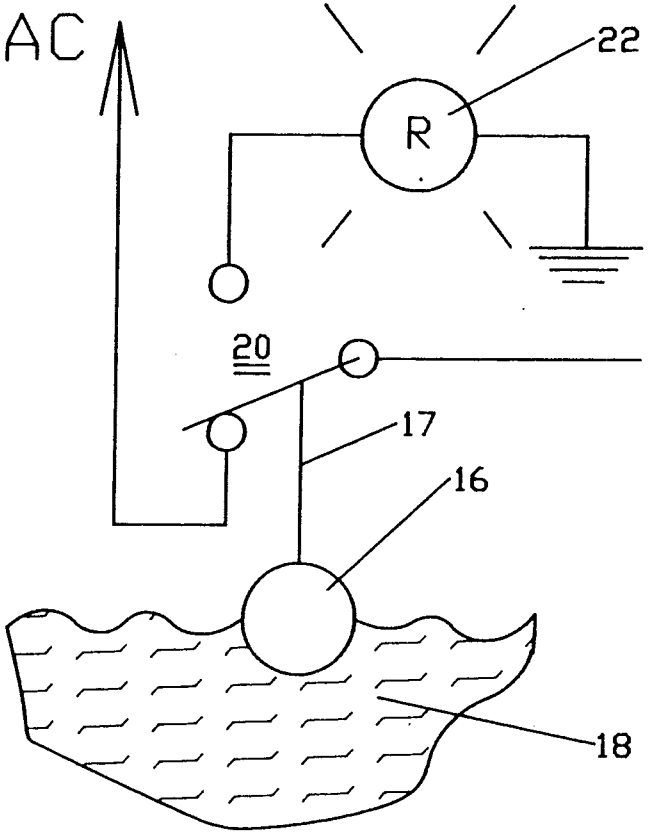
FIG. 2 is an electrical schematic of the annunciation means associated with the present invention.

In the electrical schematic of FIG. 3, it is noted that float element 16 and switch 20 will, in addition to actuating annunciation means 22, open a circuit to the compressor relay 24 and fan relay 26, thereby turning-off the compressor, air handler and refrigeration system fan when switch 20 is actuated.

In further regard to FIG. 1, there is shown a fluid junction 30 in the nature of a T intersection. Disposed within this junction is a purge port 32 and an associated flush hose 34. Shown to the right of purge port 32, and in fluid communication with the base thereof, is a pressure relief valve 36, the function of which is to assure that fluid pressure in excess of sixty five pounds per square inch cannot be introduced into line 12 through said hose 34.

To the right of junction 30 is shown a first condensate line closure valve 38 which is disposed upstream of said purge port 32. Said closure valve may be either hand operated or, if desired, electrically actuatable through the use of a solenoid closure valve. Disposed downstream of purge port 32 is a second condensate line closure valve 40 which is placed within line 41 which line represents an extension of condensate line 12 however downstream of junction 30. Area 42 represents the fluid output of the entire system.

In the event that the blockage within line 12 occurs upstream of first closure valve 38, that is, to the right thereof, said second closure valve 40 will be closed while said first closure valve 38 will be placed in an opened condition. Thereupon, a medium such as compressed air, freon or a freon alternative will be introduced from hose 34, through purge port 32 and, therefrom, into line 12. The introduction of such a pressurized fluid or gas into line 12 will clear any blockage that may have occurred therein. In addition, it has been found that the use of negative pressure, i.e., suction at purge port 32 is highly effective in clearing line blockages and, in addition, reduces the possibility that the material causing the blockage will become forced into the air handler or compressor or some other element or the air conditioning system thereby causing a problem of a different type within a different area of the refrigeration system.

In the event that the blockage occurs downstream of first closure valve 38, that is, to the left of valve 38, said valve is closed, while second closure valve 40 is opened. Thereupon, the compressed air, gas or the like as introduced through purge port 32 to thereby clear the blockage downstream of valve 38. As above noted, either positive or negative fluid pressure may be employed in this function.

As an option within the above described system, a pump 39 may be placed within removal line 12 upstream of valve 38.

Figure 4:
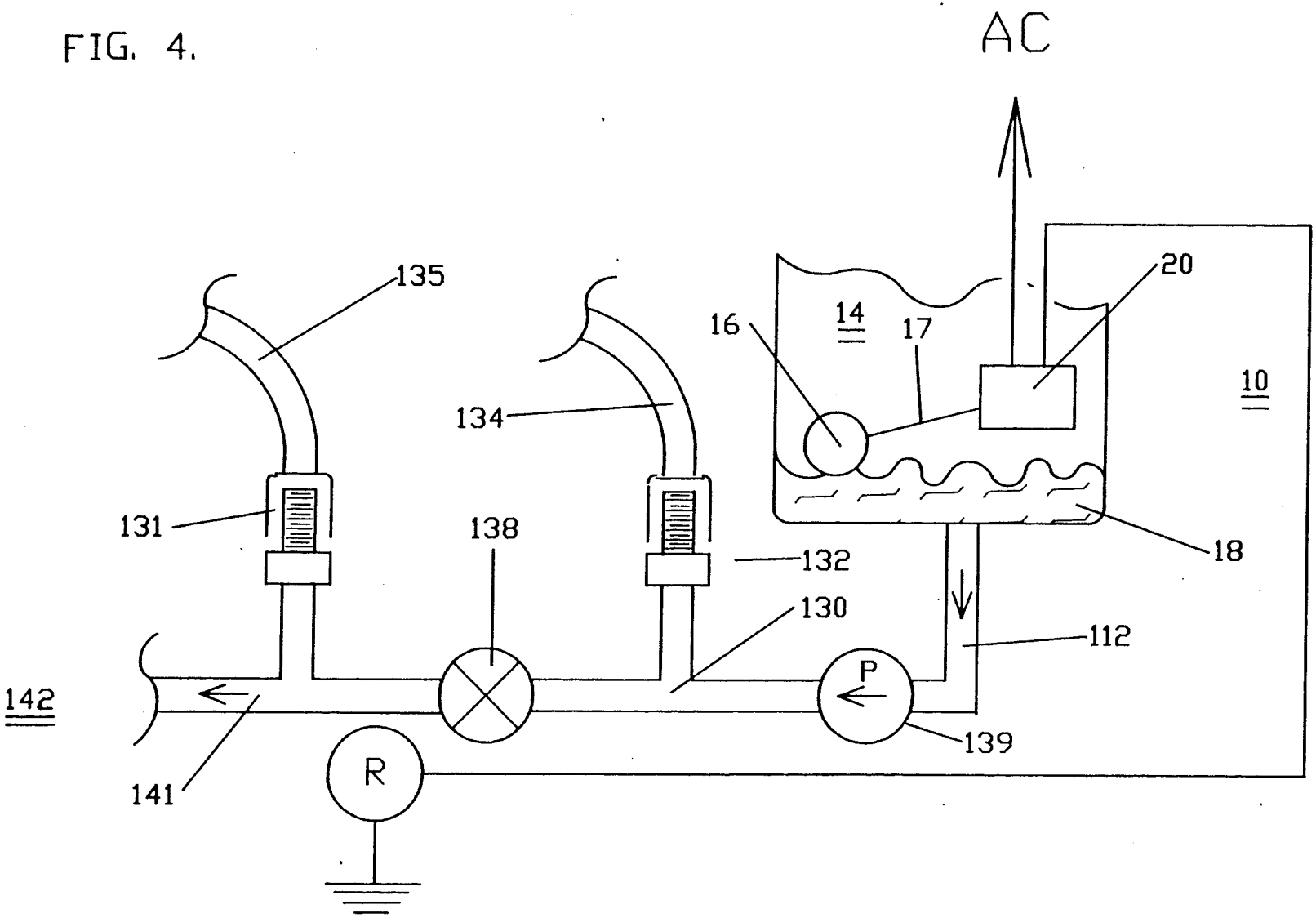
FIG. 4 is a mechanical schematic showing a second embodiment of the instant invention.

With respect to the schematic view of FIG. 4, there is shown a second embodiment of the instant invention. Therein, there is employed a single closure valve 138 which, as is the case in said valves 38 and 40 of the embodiment of FIG. 1, may be opened or closed either manually or, if a solenoid is employed, electrically. In this embodiment, if a blockage were to occur upstream of closure valve 138, that valve would be closed while a pressurized fluid input 134 would be introduced into a first purge port 132 which is disposed upstream of closure valve 138.

In the event of a blockage downstream of closure valve 138, a pressurized fluid input 135 would be introduced into second purge port 131 which is located downstream of closure valve 138. As is the case in the embodiment of FIG. 1, either positive or negative fluid pressure may be employed at purge ports 131 and 132.

As an option within the embodiment of FIG. 4, a pump 139 may be placed within return line 112 upstream of T-junction 130.

Figure 5:
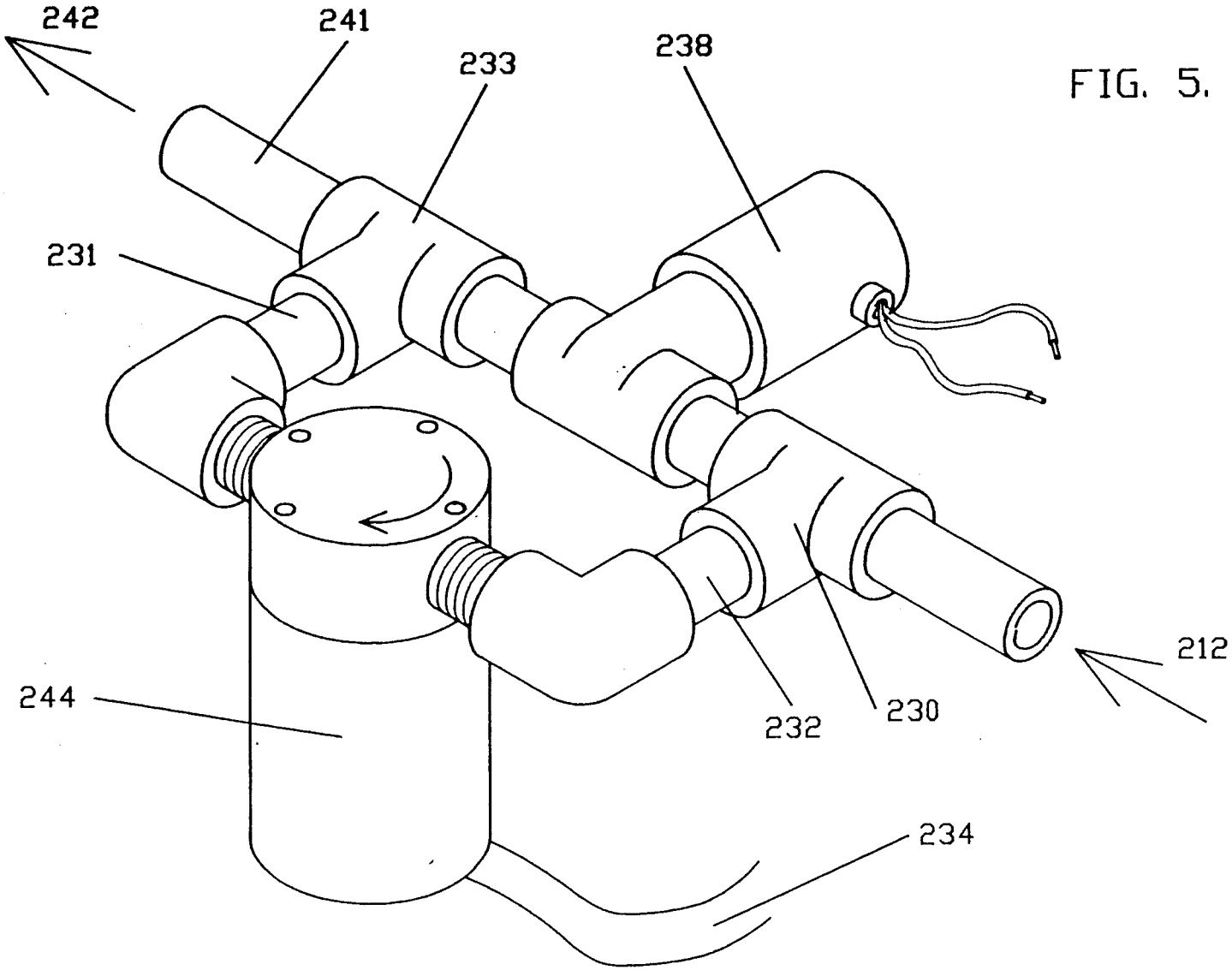
FIG. 5 is a mechanical schematic view showing a third embodiment of the invention.

A further embodiment of the invention appears in FIG. 5 and is comprised of the following items:

Two T-junctions 230 and 233 which are in line of an existing drainline 212. A solenoid valve 238 is also in line of existing drainline 212. A centrifugal pump 244 is in parallel with the existing drainline and is connected to junctions 230 and 238 through conduits 232 and 231 respectively. A float or sensor (not shown) is mounted in the drain pan of air-conditioner.

In the event of a blockage, the float will open the contacts to the compressor and air-handler circuits and will close the contacts to the solenoid valve 238 and centrifugal pump 244 whereby the said pump will evacuate any blockage at the outlet of the drain pan and drainline 212 and pump-out the system to exit 242. On completion of that task, the float will resume its normally closed position and will deactivate the in line solenoid valve 238 and centrifugal pump 244 and will re-activate the compressor and air-handler circuits.

In view of the above, it may be appreciated that the purging of a condensate removal line of a refrigeration system may be readily effectuated, after the system has been disabled and the user alerted, through the embodiments as above set forth.

Accordingly, while there has been shown and described the preferred embodiments of the present invention, it is to be appreciated that the invention may be embodied otherwise than is herein specifically shown and described, and that within said embodiment, certain changes may be made in the detail thereof without departing form the principles of this invention within the scope of the claims appended herewith.

Having thus described my invention, what I claim as new, useful and non-obvious and, accordingly secure by Letters Patent in the United States is:

1. A sediment and alert purging unit for a condensate removal line of a refrigeration system, the alert purging unit comprising:

(a) means for monitoring the level of condensate within the condensate removal pan or line refrigeration system;

(b) switch means in electrical communication with said monitoring means, for disabling at least a compressor or air handler of said refrigeration system responsive to an unacceptable level of condensate in said removal line;

(c) annunciation means in electrical communication with said switch means, to alert a user when a disabling of said compressor has occurred;

(d) a purge port disposed within said condensate removal line downstream of said monitoring means;

(e) a first condensate line closure valve disposed upstream of said purge port; and (f) a second condensate line closure valve diposed downstream of said purge port, whereby pressurized fluid may be introduced within said purge port while a selectable one of said closure valves is closed to permit the purging of the condensate line of any blockage therein.

2. The system as recited in claim 1 in which said purge port further comprises a pressure relief means.

3. The system as recited in claim 1 further comprising a fluid pump disposed within the condensate removal line upstream of said first closure valve.

4. The system as recited in claim 1 in which said refrigeration system comprises an air conditioning system.

5. The sediment alert and purging unit for a condensate removal line of a refrigeration system, the alert and purging unit comprising;

(a) means for monitoring the level of condensate within the condensate removal pan or line of a refrigeration system;

(b) switch means in electrical communication with said monitoring means, for disabling at least compressor of said refrigeration system responsive to an unacceptable level of condensate within said removal line;

(c) annunciation means in electrical communication with said switch means to alert the user of the system when a disabling of the compressor or air handler has occurred;

(d) a condensate line closure valve within said condensate line downstream of said monitoring means;

(e) a first purge port within said condensate line and upstream of said closure valve; and (f) a second purge port disposed within said condensate line and downstream of said closure valve, whereby blockages within said condensate line may be cleared through the introduction of pressurized fluid in a selectable one of said purge ports dependent upon the location of the condensate line blockage.

6. The system as recited in claim 5 in which said closure valve is in electrical communication with said monitoring means and is actuated responsive thereto.

7. The system as recited in claim 5 in which at least one of said purge ports further comprise pressure relief means.

8. The system as recited in claim 5 in which said refrigeration system comprises an air conditioning system.

9. The system as recited in claim 5 further comprising a fluid pump disposed upstream of said purge port.

10. The system as recited in claim 6, further comprising:

pump means having an input in fluid communication with said first purge port and having an output in fluid communication of said second port.

* * * * *